US006838630B2

(12) United States Patent
Sasaki

(10) Patent No.: US 6,838,630 B2
(45) Date of Patent: Jan. 4, 2005

(54) SWITCH DEVICE

(75) Inventor: Makoto Sasaki, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/458,975

(22) Filed: Jun. 10, 2003

(65) Prior Publication Data

US 2003/0226748 A1 Dec. 11, 2003

(30) Foreign Application Priority Data

Jun. 11, 2002 (JP) ..... 2002-170209

(51) Int. Cl.[7] ..... H01H 21/00
(52) U.S. Cl. ..... 200/553; 200/18
(58) Field of Search ..... 200/553, 5 R, 200/6 BB, 5 E, 1 V, 6 R, 18, 11 G, 6 C, 339, 430, 433, 437, 439

(56) References Cited

U.S. PATENT DOCUMENTS 4,000,383 A * 12/1976 Lockard ..... 200/16 D
4,022,999 A * 5/1977 Brown ..... 200/437
4,203,017 A * 5/1980 Lee ..... 200/437
4,686,339 A * 8/1987 Sapone ..... 200/339
4,767,895 A * 8/1988 Parrish ..... 200/43.04
5,041,706 A * 8/1991 Osika et al. ..... 200/296
5,265,716 A 11/1993 Sawada et al.

* cited by examiner

*Primary Examiner*—Elvin Enad
*Assistant Examiner*—Lisa Klaus
(74) *Attorney, Agent, or Firm*—Brinks Hofer Gilson & Lione

(57) ABSTRACT

Drivers which are resiliently biased to leaf members bring portions to be pushed and slide operating portions thereof into resilient contact with pressing projections of a manipulating knob and conductive plates respectively and hence, when the portions to be pushed are pushed by the manipulating knob, the slide operating portions slide on the conductive plates. Further, contact positions between the slide operating portions and the conductive plates in a non-loaded state in which the manipulating knob is not present is set by preliminarily considering that the drivers are slightly rotated when the manipulating knob is mounted in a preloaded state. Accordingly, the portions to be pushed are slightly elevated when they are pushed by the manipulating knob.

5 Claims, 7 Drawing Sheets

SWITCH DEVICE

BACKGROUND OF THE INVENTION

1. Field of the Invention

The present invention relates to a switch device which is tiltably manipulated by a manipulating knob, and more particularly to a switch device which can be changed over between an ON state and an OFF state by tilting a conductive plate so as to bring the conductive plate into contact with fixed contact members or to separate the conductive plate from the fixed contact members. The switch device is suitably used as a driving switch of a vehicle-mounted power window device.

2. Description of the Related Art

FIG. 13 is a cross-sectional view showing this type of switch device which constitutes a related art. As shown in the drawing, to a casing 1 having a bottom wall 1*a,* first, second and third fixed contact members 2*a,* 2*b,* 2*c* are fixedly mounted by insert molding. Three terminals 8 are extended from the respective fixed contact members 2*a,* 2*b,* 2*c* downwardly below the casing 1. The respective fixed contact members 2*a* to 2*c* are exposed on a bottom wall la of the casing 1 and a conductive plate 3 is tiltably arranged using the center fixed contact member 2*a* as a fulcrum. The conductive plate 3 is a metallic plate having an approximately M shape as viewed from a side face which includes a pair of raised portions 3*b,* 3*c* at both sides of a valley 3*a*. The conductive plate 3 has one longitudinal end thereof capable of being in contact with and separated from the fixed contact member 2*b* and another longitudinal end thereof capable of being in contact with and separated from the fixed contact member 2*c*. An actuator 4*a* of a driver 4 is-arranged above the conductive plate 3. The driver 4 is always biased to the bottom wall la side by a coil spring 5 and hence, the actuator 4*a* is resiliently brought into contact with the conductive plate 3. These driver 4 and the coil spring 5 are incorporated inside a housing 6*a* of a rotary lever 6. The rotary lever 6 is rotatably supported on a lid body 7 which is mounted on the casing 1 such that the lid body 7 covers the casing 1. A manipulating knob not shown in the drawing is mounted on the rotary lever 6 by suitable means. The manipulating knob is a member which is tiltably manipulated by a manipulator. Since the rotary lever 6 is rotated along with tilting of the manipulating knob, an actuator 4*a* of the driver 4 slides on the conductive plate 3.

FIG. 13 shows a non-manipulated state in which the rotary lever 6 is not rotated, wherein the fixed contact members 2*a,* 2*c* become conductive through the conductive plate 3 and a switch-off state is held between the fixed contact members 2*a,* 2*b*. In this state, when the manipulating knob is pushed to rotate the rotary lever 6 in the clockwise direction shown in the drawing, the actuator 4*a* slides on the raised portion 3*b* while compressing the coil spring 5 and hence, when the actuator 4*a* passes over the fixed contact member 2*a,* the conductive plate 3 is rotated in the counter clockwise direction shown in the drawing. As a result, the conductive plate 3 is separated from the fixed contact member 2*c* and is brought into contact with the fixed contact member 2*b* and hence, the fixed contact members 2*a,* 2*b* become conductive by way of the conductive plate 3 whereby the state is changed over to a switch-on state. Then, when the manipulating force which pushes the manipulating knob is removed, the actuator 4*a* slides on the raised portion 3*b* in a reverse direction due to a restoring force of the coil spring 5. Accordingly, when the actuator 4*a* passes over the fixed contact member 2*a,* the conductive plate 3 is rotated in a reverse direction and returns to the state shown in FIG. 13 whereby the switch-off state is automatically restored between the fixed contact members 2*a,* 2*b*.

Further, in the state shown in FIG. 13, when the rotary lever 6 is rotated in the counter clockwise direction as shown in the drawing by way of the manipulating member, although the actuator 4*a* slides over the raised portion 3*c,* the conductive late 3 is preliminarily pushed to the fixed contact member 2*c* and hence, the conductive plate 3 is not rotated. Accordingly, the switch-off state is held as it is between the fixed contact members 2*a,* 2*b*.

Here, by arranging groups of fixed contact members 2*a* to 2*c* to the bottom wall la of the casing 1 in two rows and by arranging the conductive plate 3, the actuator 4*a* and the like for every group of fixed contact members 2*a* to 2*c,* it is possible to arrange in parallel two sets of switching elements which use the casing 1 and the rotary lever 6 in common. Accordingly, by arranging two sets of switching elements in a point symmetry in a plan view, it is possible to obtain a dipole and double-throw type switch device in which one switching element outputs a first driving signal when the manipulating knob is pushed in one direction and another switching element outputs a second driving signal when the manipulating knob is pushed in another direction.

Such a switch device is popularly used as a driving switch of a vehicle-mounted power window device. In this case, during a period that the manipulating knob is pushed, it is possible to output the driving signal for performing an opening operation or a closing operation of a window and hence, it is possible to perform the manual manipulation which can arbitrarily set the degree of opening of the window.

In the conventional switch device shown in FIG. 13, the driver 4 is elevated or descended in the housing 6*a* along with the rotation of the rotary lever 6 and hence, it is necessary to ensure a clearance between the driver 4 and the rotary lever 6 and this clearance is perceived as a play at the time of manipulation. Further, when the manipulating knob is mounted on the rotary lever 6 by snap fitting, a play is liable to be formed between the manipulating knob and the rotary lever 6. Accordingly, this type of conventional switch device has a drawback that it is difficult to obtain the favorable manipulation feeling free from plays.

SUMMARY OF THE INVENTION

The present invention has been made in view of the above circumstances of the related art and it is an object of the present invention to provide a tilting manipulating type switch device which can always obtain a favorable manipulation feeling by eliminating plays at the time of manipulation.

To achieve the above-mentioned object, a switch device according to the present invention includes a casing having a bottom wall, two sets of switch elements which are incorporated into the casing, and a manipulation knob which has a pair of pushing projections for selectively operating the two sets of switch elements, the switch element including a plurality of fixed contact members which are fixed to the casing and are exposed on the bottom wall, a conductive plate which is tiltably arranged on the bottom wall and is brought into contact with and separated from at least one of the fixed contact members, a driver which is arranged above the conductive plate in a state that elevation/descending operation thereof is allowed and is rotatable about a shaft, and a spring member which resiliently biases the shaft of the driver toward the bottom wall, wherein the driver includes a portion to be pushed which is projected outside the casing in a sideward direction and is resiliently brought into contact with the pushing projection due to a biasing force of the spring member and a slide operating portion which slides on an inclined surface of the conductive plate when the portion to be pushed is pushed by the pushing projection, a preloaded state in which the pushing projection pushes the portion to be pushed by a fixed quantity is established at the time of mounting the manipulating knob, and a contact position between the slide operating portion and the conductive plate in a non-loaded state in which the manipulating knob is not present is set such that the slide operating portion is brought into contact with a given position on the conductive plate in the preloaded state.

In the switch device having such a constitution, the driver which is resiliently biased to the spring member resiliently brings the portion to be pushed and the slide operating portion into contact with the manipulating knob and the conductive plate respectively. Accordingly, at the time of manipulating, the pushing projection of the manipulating knob directly pushes the portion to be pushed so as to rotate the driver and the slide operating portion is made to slide on the conductive plate along with the rotation of the driver. Further, when a manipulating force applied to the manipulating knob is removed, the spring member pushes back the driver which is rotated against a biasing force of the spring member and hence, the slide operating portion is made to slide in the reverse direction on the conductive plate and, at the same time, the pushing projection of the manipulating knob which pushes the portion to be pushed is pushed up by the portion to be pushed. Accordingly, there is no fear that a play is formed by the driver or the manipulating knob so that it is possible to always obtain a favorable manipulation feeling.

Further, in this switch device, the contact position between the slide operating portion and the conductive plate in the non-loaded state in which the manipulating knob is not present is set by considering that the driver is slightly rotated when the manipulating knob is mounted in the preloaded state. Accordingly, there is substantially no fear that the positional displacement of the slide operating portion on the conductive plate occurs when the manipulating knob is mounted in the preloaded state. Accordingly, an operational failure such as an undesirable earlier ON timing at the time of manipulation can be prevented in advance.

For example, the switch device may be configured such that the conductive plate includes a raised portion on which the inclined surface is formed, an initial receiving portion which is contiguously formed at one end of the raised portion and is brought into contact with a slide operating portion of the driver in the non-loaded state, and a movable contact which is extended from another end of the raised portion can be brought into contact with and separated from any one of the fixed contact members, and in the preloaded state in which the manipulating force is not applied, the slide operating portion is brought into contact with the inclined surface in the vicinity of the initial receiving portion. In such a constitution, when the manipulating force is not applied, a force which makes the slide operating portion descend along the inclined surface acts on the slide operating portion and hence, the portion to be pushed of the driver is biased in the direction which pushes the pushing projection upwardly whereby it is possible to easily prevent the occurrence of a play of the manipulating knob. In such a constitution, when the portion to be pushed of the driver is pushed by the pushing projection of the manipulating knob, the slide operating portion slides on the raised portion of the conductive plate and rotates the conductive plate so that the movable contact can be brought into contact with a given fixed contact member. By removing the manipulating force after rotating the conductive plate in this manner, the slide operating portion is made to slide on the raised portion in a reverse direction due to a restoring force of the spring member whereby it is possible to rotate the conductive plate in the reverse direction and to return the conductive plate to the preloaded state (non-manipulating state). Here, it is preferable that a plurality of fixed contact members include a first fixed contact member which is always brought into contact with the conductive plate and a second fixed contact member which is brought into contact with and separated from the movable contact, and a contact between the first fixed contact member and the conductive plate is set as a tilting fulcrum of the conductive plate. In addition, the plurality of fixed contact members may include a third fixed contact member which is brought into contact with and separated from a portion of the conductive plate which extends toward a side of the conductive plate opposite to a side of the raised portion from the initial receiving portion of the conductive plate.

Further, in the above-mentioned constitution, in each set out of the two sets of switch elements, all of the group of fixed contact members, the conductive plate and the driver may be arranged in a point symmetrical position as viewed in a plan view. Due to such a constitution, it is preferable that the whole device can be miniaturized.

DESCRIPTION OF THE PREFERRED EMBODIMENTS

Figure 1:
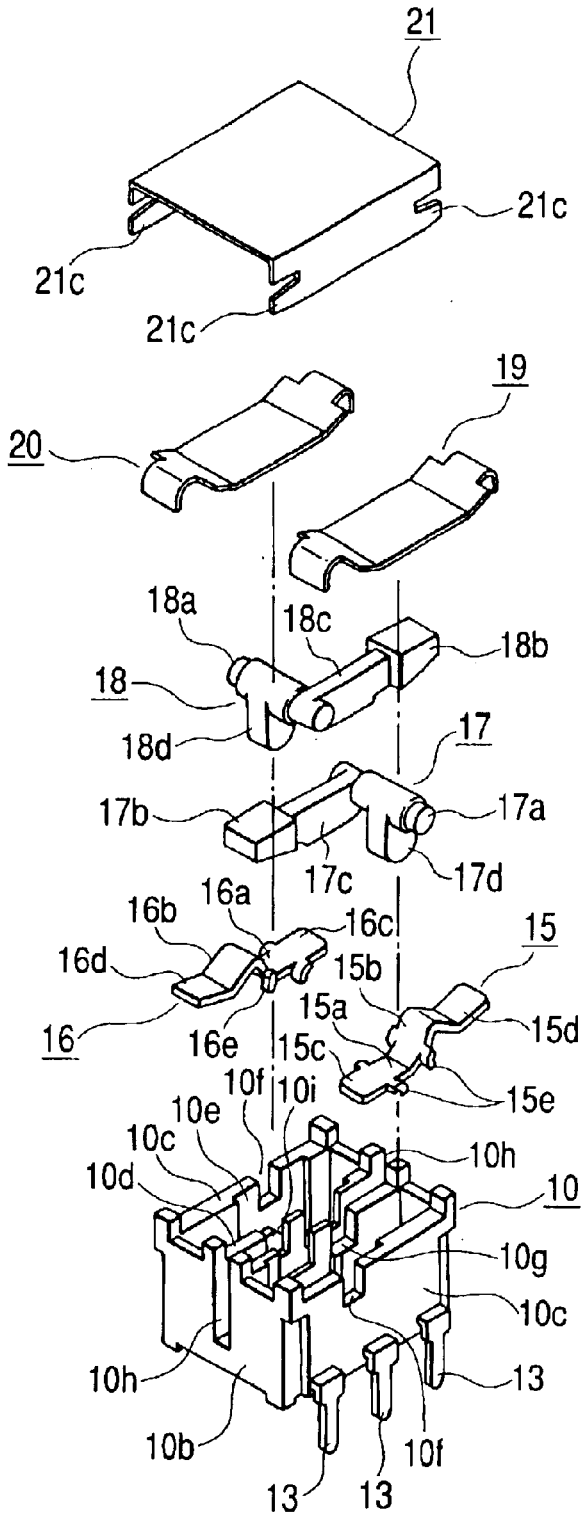
FIG. 1 is an exploded perspective view of a switch device according to an embodiment of the present invention.
Figure 2:
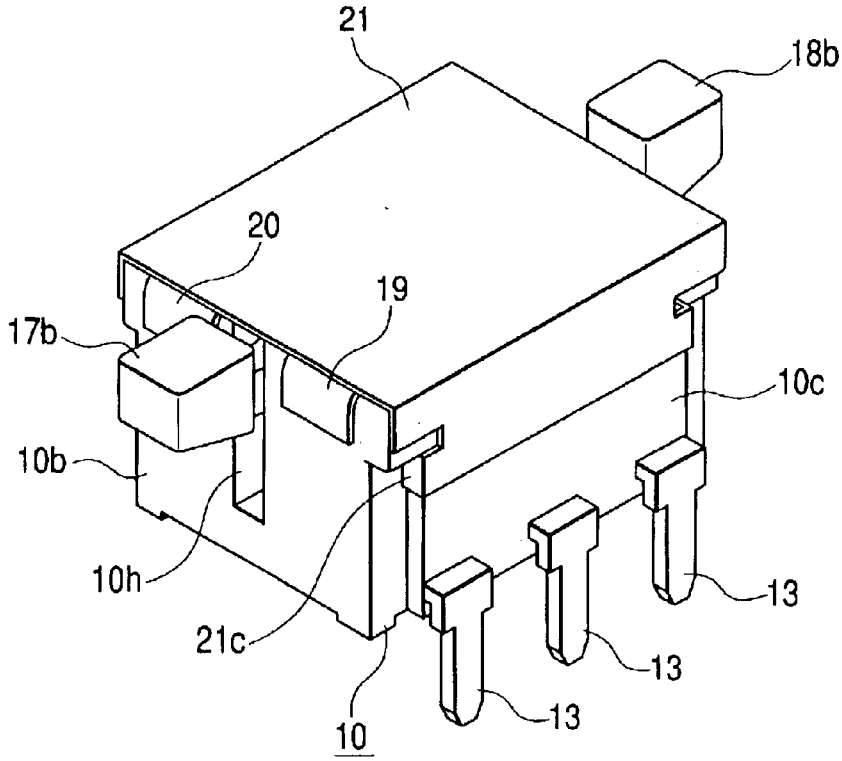
FIG. 2 is a perspective view of the switch device.
Figure 3:
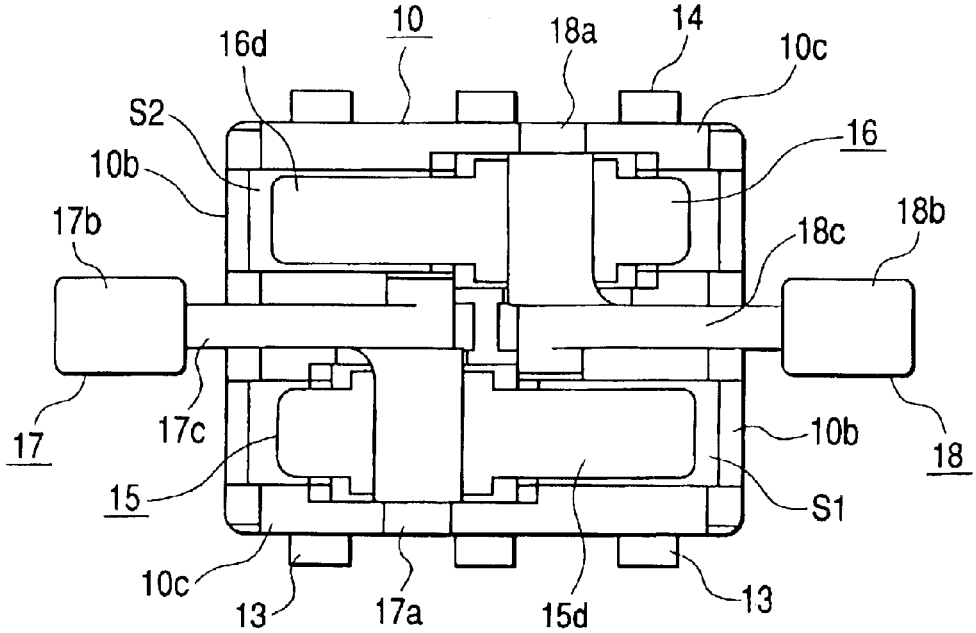
FIG. 3 is a plan view of the switch device in a state that a cover and leaf springs are omitted.
Figure 4:
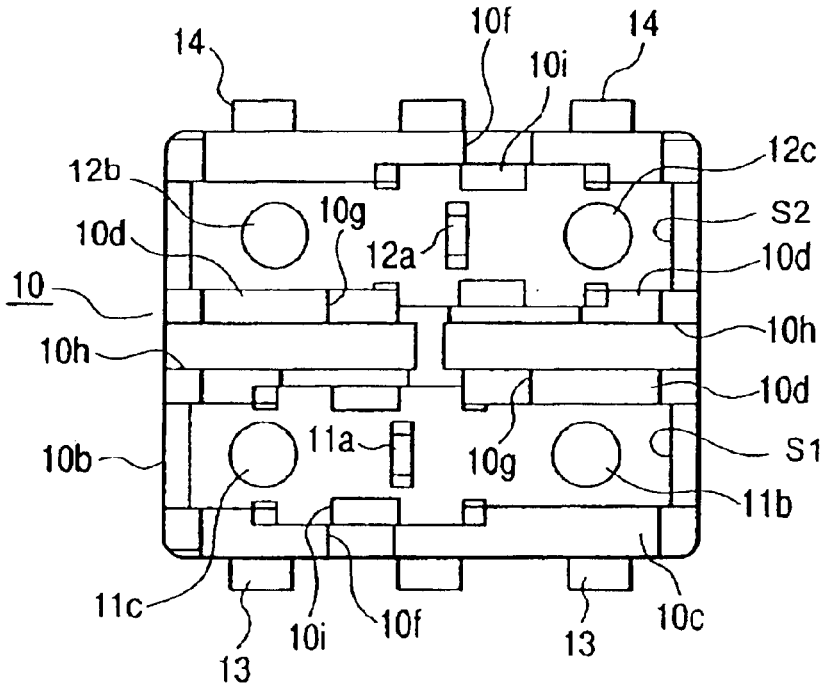
FIG. 4 is a plan view of a casing provided to the switch device.
Figure 5:
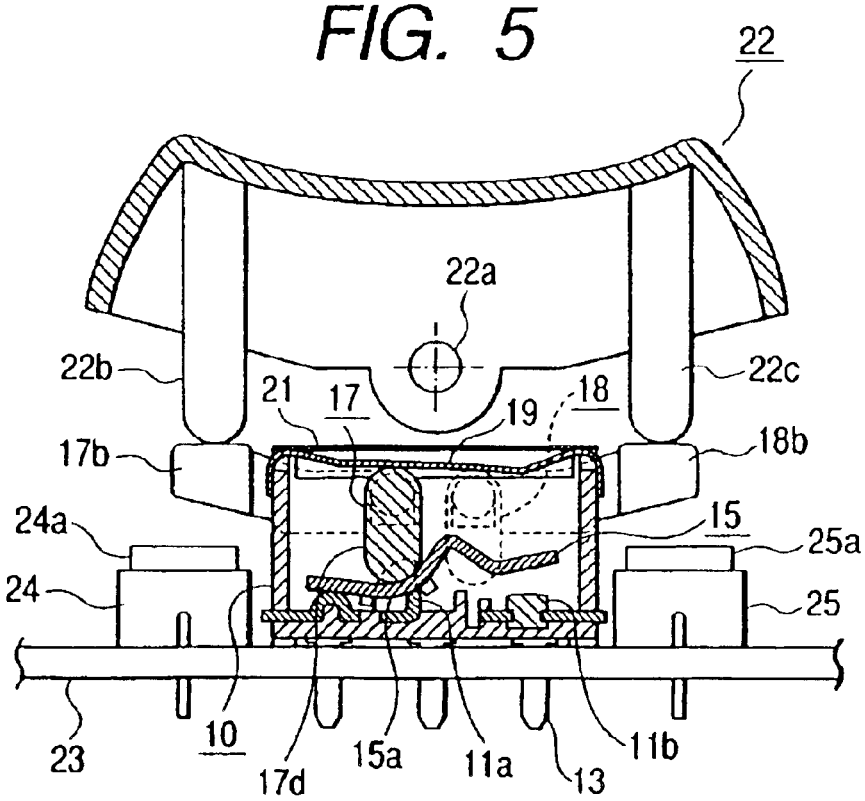
FIG. 5 is an explanatory view showing a non-manipulating state of the switch device.
Figure 6:
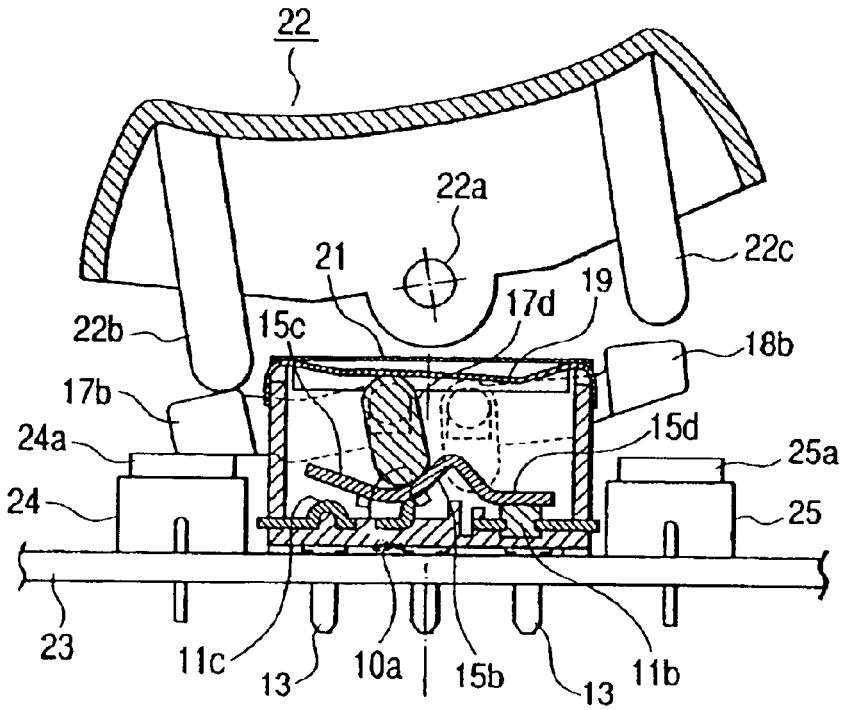
FIG. 6 is an explanatory view in a state that a conductive plate is rotated by manipulating the switch device.
Figure 7:
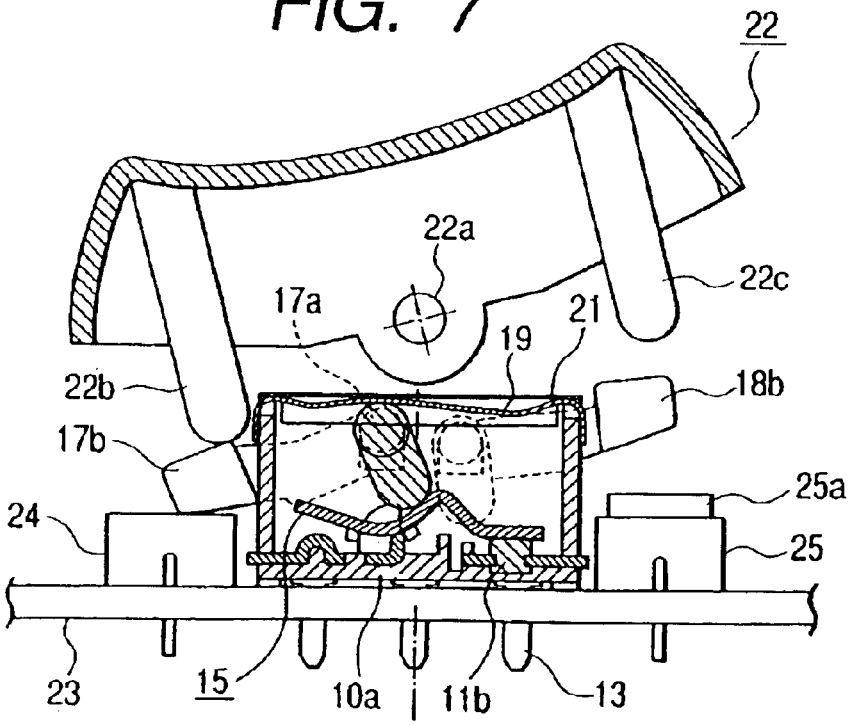
FIG. 7 is an explanatory view showing a state in which a pushing switch is operated by manipulating the switch device.
Figure 8:
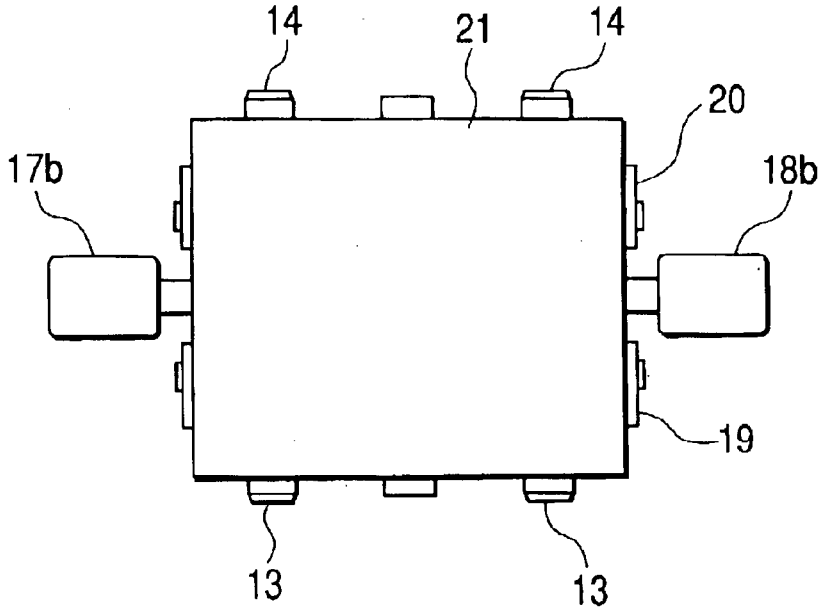
FIG. 8 is a plan view of the switch device.
Figure 9:
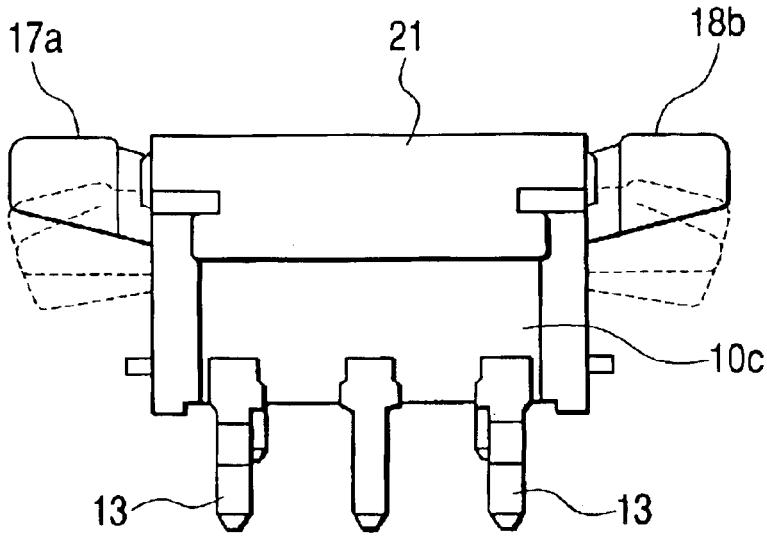
FIG. 9 is a side view of the switch device as viewed from a long side thereof.
Figure 10:
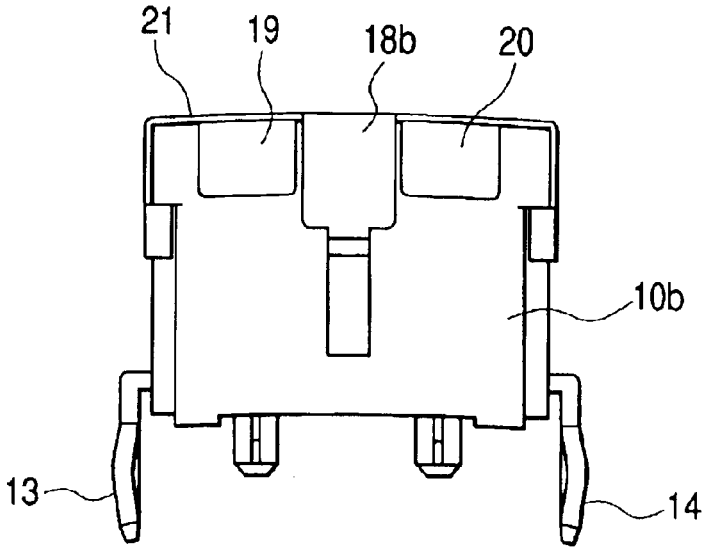
FIG. 10 is a side view of the switch device as viewed from a short side thereof.
Figure 11:
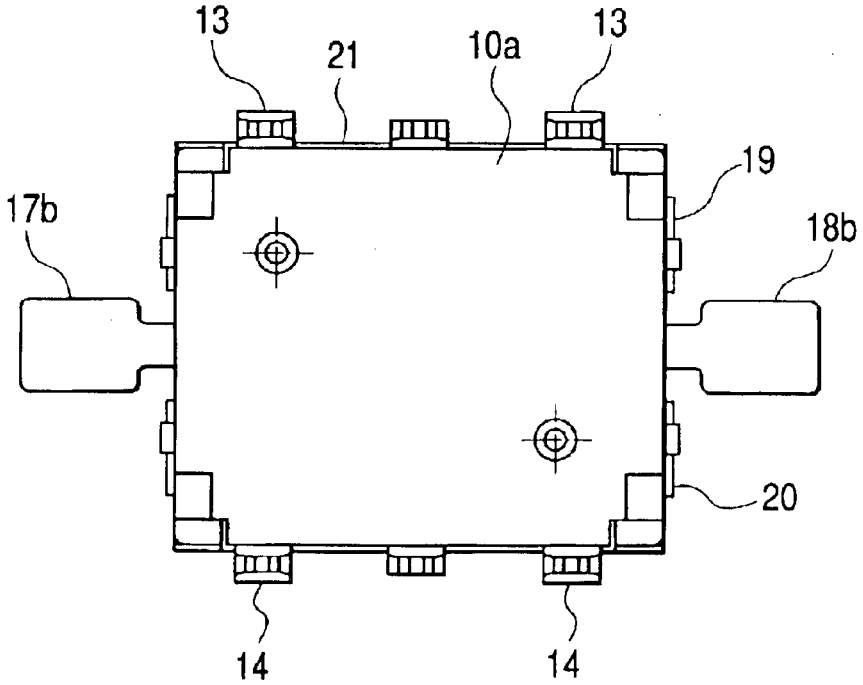
FIG. 11 is a bottom view of the switch device.
Figure 12:
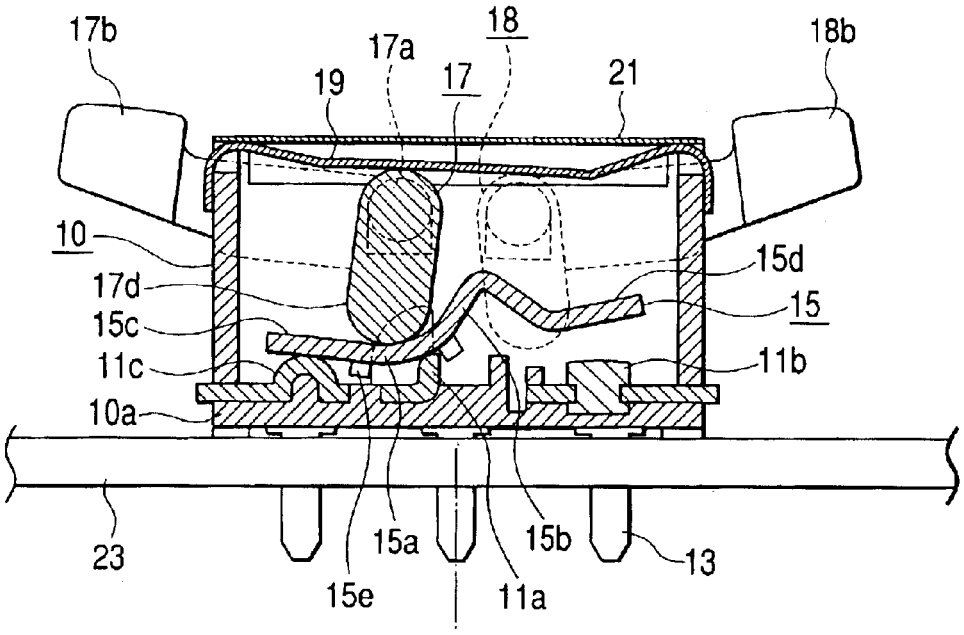
FIG. 12 is a cross-sectional view of the switch device in a non-loaded state in which a manipulation knob is not present.
Figure 13:
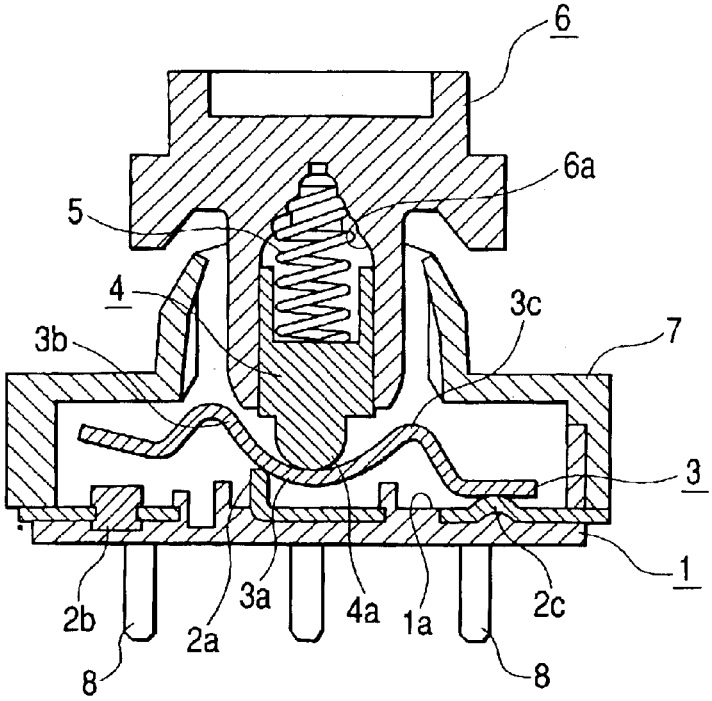
FIG. 13 PRIOR ART
FIG. 13 is a cross-sectional view of a switch device of the related art.

To explain the preferred embodiments of the present invention in conjunction with drawings, FIG. 1 is an exploded perspective view of a switch device according to an embodiment of the present invention, FIG. 2 is a perspective view of the switch device, FIG. 3 is a plan view of the switch device in a state that a cover and leaf springs are omitted, FIG. 4 is a plan view of a casing provided to the switch device, FIG. 5 is an explanatory view showing a non-manipulating state of the switch device, FIG. 6 is an explanatory view in a state that a conductive plate is rotated by manipulating the switch device, FIG. 7 is an explanatory view showing a state in which a pushing switch is operated by manipulating the switch device, FIG. 8 is a plan view of the switch device, FIG. 9 is a side view of the switch device as viewed from a long side thereof, FIG. 10 is a side view of the switch device as viewed from a short side thereof, FIG. 11 is a bottom view of the switch device, and FIG. 12 is a cross-sectional view of the switch device in a non-loaded state in which a manipulation knob is not present.

The switch device shown in these drawings is of a type which is used as a driving switch of a vehicle-mounted power window device and is a dipole and double-throw type switch device having two sets of switching elements.

The switch device includes a casing 10 which mounts side walls 10*b*, 10*c* and a partition wall 10*d* on a bottom wall 10*a* in an erected manner so as to define a pair of contact housing spaces S1, S2, a pair of groups of fixed contact members 11*a* to 11*c* and 12*a* to 12*c* which are arranged on the bottom wall 10*a* of the casing 10 by insert molding, three terminals 13 which are extended from a group of fixed contact members 11*a* to 11*c* and are projected downwardly from the casing 10, three terminals 14 which are extended from a group of fixed contact members 12*a* to 12*c* and are projected downwardly from the casing 10, a pair of guide plates 15, 16 which are tiltably arranged on the bottom wall 10*a* inside the respective contact housing spaces S1, S2, a pair of drivers 17, 18 which are arranged on the respective conductive plates 15, 16 in a state that the elevation and the descending thereof are allowed and are rotatable about shafts 17*a*, 18*a*, a pair of leaf springs 19, 20 which resiliently bias the respective shafts 17*a*, 18*a* of the drivers 17, 18 toward the bottom wall 10*a*, a cover 21 made of a metallic plate which is mounted on the casing 10 and closes an upper opening 10*e* of the casing 10 as a lid, and a manipulating knob 22 which is tiltably supported about a support shaft 22*a*. To the manipulating knob 22, a pair of pushing projections 22*b*, 22*c* are mounted such that the pushing projections 22*b*, 22*c* are projected downwardly. These pushing projections 22*b*, 22*c* are resiliently brought into contact with portions to be pushed 17*b*, 18*b* of the drivers 17, 18 respectively. Further, on a printed circuit board 23 on which the switch device is mounted, a pair of pushing switches (tact switches) 24, 25 are mounted in the vicinity of the casing 10 and manipulating portions 24*a*, 25*a* of the respective pushing switches 24, 25 are arranged below the portions to be pushed 17*b*, 18*b* respectively.

On the casing 10, two side walls 10*c* which are parallel to each other, four partition walls 10*d*, two short-side sidewalls 10*b* which are perpendicular to long-side side walls 10*c* are respectively mounted in an erected manner. As shown in FIG. 1 and FIG. 4, notched recesses 10*f*, 10*g* in which the shafts 17*a*, 18*a* of the drivers 17, 18 are inserted such that they can be elevated and descended are formed in respective upper ends (ends at the upper opening 10*e* side) of two side walls 10*c* and two partition walls 10*d*. That is, in FIG. 4, the shafts 17*a* are inserted into the left-side recesses 10*f*, 10*g* in the drawing, while the shafts 18*a* are inserted into the right-side recesses 10*f*, 10*g* in the drawing. Further, notched slits 10*h* which have upper ends thereof opened are formed in respective centers of two short-side side walls 10*b*. Arms 17*c*, 18*c* of the drivers 17, 18 are inserted into the slits 10*h* such that they can be elevated and descended. Further, projections 10*i* are formed on opposing faces of two side walls 10*c* and two partition walls 10*d* respectively and these projections 10*i* have upper portions thereof formed in an arcuate shape.

The group of fixed contact members 11*a* to 11*c* are arranged in a row on an inner bottom portion of the contact housing space S1 of the casing 10, and are comprised of the first fixed contact member 11*a* which is always brought into contact with the conductive plate 15 as a tilting fulcrum and the second and third fixed contact members 11*b*, 11*c* which are brought into contact with and separated from the conductive plate 15. In the same manner, the group of fixed contact members 12*a* to 12*c* are arranged in a row on an inner bottom portion of the contact housing space S2 of the casing 10, and are comprised of the first fixed contact member 12*a* which is always brought into contact with the conductive plate 16 as a tilting fulcrum and the second and third fixed contact members 12*b*, 12*c* which are brought into contact with and separated from the conductive plate 16. However, the group of fixed contact members 11*a* to 11*c* and the group of fixed contact members 12*a* to 12*c* are arranged in a point symmetry as viewed in a plan view. Further, three terminals 13 which are led from the respective fixed contact members 11*a* to 11*c* and three terminals 14 which are led from the respective fixed contact members 12*a* to 12*c* are all connected to an external circuit.

The conductive plate 15 is a metallic plate which includes an initial receiving portion 15*a* which supports the driver 17 in a non-loaded state in which the manipulating knob 22 is not present (see FIG. 12), a raised portion 15*b* having an inverse V shape as viewed from the side which forms a contiguous inclined surface at one side of the initial receiving portion 15*a*, a plane 15*c* which is extended to another side of the initial receiving portion 15*a*, and a movable contact 15*d* which is extended to a side opposite to the initial receiving portion 15*a* side from the raised portion 15*b*. The movable contact 15*d* can be brought into contact with and separated from the fixed contact member 11*b*, while the plane 15*c* can be brought into contact with or separated from the fixed contact member 11*c*. Further, four projections 15*e* are formed on the both lateral sides of the conductive plate 15 such that the projections 15*e* sandwich the initial receiving portion 15*a*. By engaging these projections 15*e* with projections 10*i* of the casing 10, it is possible to restrict the longitudinal displacement of the conductive plate 15 at the time of tilting. The conductive plate 16 has the same shape as the conductive plate 15 and includes a raised portion 16*b* and a plane 16*c* at both sides of the initial receiving portion 16*a*. A movable contact member 16*d* which is extended to the longitudinal one end side can be brought into contact with or separated from the fixed contact member 12*b* and the plane 16*c* at longitudinally another side can be brought into contact with and separated from the fixed contact member 12*c*. Also, four projections 16*e* are formed on the both lateral sides of the conductive plate 16 such that the projections 16*e* sandwich the initial receiving portion 16*a*. By engaging these projections 16*e* with projections 10*i* of the casing 10, it is possible to restrict the longitudinal displacement of the conductive plate 16 at the time of tilting. Here, the pair of conductive plates 15, 16 are also arranged in a point symmetry as viewed in a plan view.

The driver 17 includes a slide operating portion 17*d* which extends downward from a shaft 17*a* and is arranged on the conductive plate 15, an arm 17*c* which extends sideward from the shaft 17*a* and is inserted into a one-side slit 10*h*, and a portion to be pushed 17*b* which is formed on a distal end of the arm 17*c* and is arranged outside the side wall 10*b*. In the same manner, the driver 18 includes a slide operating portion 18*d* which extends downward from a shaft 18*a* and is arranged on the conductive plate 16, an arm 18*c* which extends sideward from the shaft 18*a* and is inserted into an another-side slit 10*h*, and a portion to be pushed 18*b* which is formed on a distal end of the arm 18*c* and is arranged outside the side wall 10*b*. As shown in FIG. 3, these drivers 17, 18 are incorporated in a point symmetry as viewed in a plan view, wherein the respective arms 17*c*, 18*c* are arranged on a straight line. That is, in assembling the drivers 17, 18 into the casing 10, the arms 17*c*, 18*c* are arranged in a narrow-wide space which is disposed between the contact housing spaces S1, S2 in the casing 10, the portions to be pushed 17*b*, 18*b* are respectively arranged outside a pair of slits 10*h* which oppose face each other in an opposed manner by way of the narrow-width space, and the shafts 17*a* are inserted into a pair of one-side recesses 10*f*, 10*g* while the shafts 18 are inserted into a pair of another-side recesses 10*f*, 10*g*.

The leaf spring 19 is mounted on the side wall 10*b* of the casing 10 and resiliently biases the shaft 17*a* of the driver 17 toward the bottom wall 10*a* and hence, the slide operating portion 17*b* of the driver 17 is resiliently brought into contact with the conductive plate 15 due to a biasing force thereof. Then, when the driver 17 is rotated about the shaft 17*a*, the slide operating portion 17*d* slides on the conductive plate 15 so as to rotate the conductive plate 15. In the same manner, the leaf spring 20 is also mounted on the side wall 10*b* and resiliently biases the shaft 18*a* of the driver 18 toward the bottom wall 10*a* and hence, the slide operating portion 18*d* of the driver 18 is resiliently brought into contact with the conductive plate 16 due to a biasing force thereof. Then, when the driver 18 is rotated about the shaft 18*a*, the slide operating portion 18*d* slides on the conductive plate 16 so as to rotate the conductive plate 16.

That is, the switch device is configured such that the first switch element which arranges the leaf spring 19, the driver 17, the conductive plate 15 and the group of fixed contact members 11*a* to 11*c* inside the contact housing space S1 and the second switch element which arranges the leaf spring 20, the driver 18, the conductive plate 16 and the group of fixed contact members 12*a* to 12*c* inside the contact housing space S2 are arranged in parallel inside the casing 10. Further, mounting lugs 21*c* are formed on four corners of a lower end of the cover 21. By bending these mounting lugs 21*c* to four corners of the casing 10, the cover 21 is mounted on the casing 10 in a state that an upper opening 10*e* is closed with a lid.

Further, in mounting the manipulating knob 22 at a final stage of assembling steps of the switch device, as shown in FIG. 5, a pair of pushing projections 22*b*, 22*c* are respectively resiliently brought into contact with the portions to be pushed 17*b*, 18*b* of the drivers 17, 18 so as to establish a state in which a pre-tension is applied (preloaded state). In this state, the slide operating portion 17*d*, 18*d* of the drivers 17, 18 are respectively positioned on the lower ends of the raised portions 15*b*, 16*b* of the conductive plates 15, 16 and hence, the respective slide operating portions 17*d*, 18*d* are respectively brought into contact with inclined surfaces of the raised portions 15*b*, 16*b*. Accordingly, in a non-loaded state in which the manipulating knob 22 is not present, that is, in a state before the manipulating knob 22 is mounted in the assembling step, it is impossible to support the drivers 17, 18 by the inclined raised portions 15*b*, 16*b*. That is, as shown in FIG. 12, the respective slide operating portions 17*d*, 18*d* are respectively brought into contact with the initial receiving portions 15*a*, 16*a* so that the portions to be pushed 17*b*, 18*b* are positioned slightly above the height position shown in FIG. 5 correspondingly. That is, to obviate the presence of plays between the manipulating knob 22 and the drivers 17, 18, as shown in FIG. 5, it is necessary to establish the preloaded state in which the manipulating knob 22 pushes the portions to be pushed 17*b*, 18*b* at the time of non-manipulation by a fixed quantity. Accordingly, in this embodiment, by considering the rotations-of drivers 17, 18 which are generated by this pushing of the portions to be pushed 17*b*, 18*b* by a fixed quantity, in the non-loaded state in which the manipulating knob 22 is not present, the slide operating portions 17*d*, 18*d* are respectively set such that they are positioned on the initial receiving portions 15*a*, 16*a* of the conductive plates 15, 16. This can be easily realized by suitably adjusting shapes of the conductive plates 15, 16.

To explain the manner of operation of the switch device having such a constitution, in the non-manipulating time, as shown in FIG. 5, the slide operating portion 17*d* of the driver 17 is resiliently brought into contact with the lower end (vicinity of initial receiving portion 15*a*) of the raised portion 15*b* of the conductive plate 15 and hence, the fixed contact members 11*a*, 11*c* are made conductive to each other by way of the conductive plate 15, while the switch-off state is held between the fixed contact members 11*a*, 11*b*. Here, since the slide operating portion 18*d* of the driver 18 is resiliently brought into contact with the lower end (vicinity of the initial receiving portion 16*a*) of the raised portion 16*b* of the conductive plate 16, the fixed contact members 12*a*, 12*c* are made conductive to each other by way of the conductive plate 16, while the switch-off state is held between the fixed contact members 12*a*, 12*b*.

In this state, when the manipulating knob 22 is manipulated by pushing and is rotated in the counter clockwise direction as shown in FIG. 5 by a given quantity, the portion to be pushed 17*b* of the driver 17 is pushed to the pushing projection 22*b* of the manipulating knob 22 and the arm 17*c* is rotated in the counter clockwise direction. Accordingly, the shaft 17*a* is slightly elevated and deflects a center of the leaf spring 19 upwardly by pushing and the slide operating portion 17*d* slides on the raised portion 15*b* of the conductive plate 15, and when the slide operating portion 17*d* passes over the fixed contact 11*a*, the conductive plate 15 is rotated in the clockwise direction in the drawing (see FIG. 6). Further, along with such pushing manipulation of the manipulating knob 22, the pushing projection 22*c* is elevated and hence, the driver 18 assumes the non-loaded state. Accordingly, the slide operating portion 18*d* is moved to a position above the initial receiving portion 16*a* and hence, the portion to be pushed 18*b* is slightly pushed upwardly. However, even when the slide operating portion 18*d* moves from the raised portion 16*b* to the initial receiving portion 16*a*, the posture of the conductive plate 18 is not changed and hence, there is no change in an output signal from the terminal 14. To the contrary, the conductive plate 15 is rotated in a process in which the slide operating portion 17*d* slides on the raised portion 15*b* and the planner portion 15*c* is separated from the fixed contact member 11*c* and the movable contact 15*d* is brought into contact with the fixed contact member 11*b*. Accordingly, a switch-on changeover signal generated by the conductive state between the fixed contact members 11*a*, 11*b* by way of the conductive plate 15 (drive signal for making the window perform the opening operation) is outputted from the terminal 13.

Further, when the manipulating force applied to the manipulating knob 22 is removed in a state shown in FIG. 6, a restoring force of the leaf spring 19 acts on the shaft 17*a* of the driver 17 so that the slide operating portion 17*d* slides in the reverse direction along the inclined surface of the raised portion 15*b*. Accordingly, when the slide operating portion 17*d* passes over the fixed contact member 11*a*, the conductive plate 15 is rotated in the reverse direction and, at the same time, the portion to be pushed 17*b* pushes the pushing projection 22*b* upwardly so that the pushing projection 22*b* returns to the state shown in FIG. 5. Accordingly, although the portion to be pushed 18*b* of the driver 18 is again pushed by the pushing projection 22*c* and the slide operating portion 18*d* moves on the raised portion 16*b*, the posture of the conductive plate 16 is not changed and hence there is no change with respect to the output signal from the terminal 14. To the contrary, with respect to the conductive plate 15, the movable contact 15*d* is separated from the fixed contact member 11*b* and the planner portion 15*c* is brought into contact with the fixed contact member 11*c* and hence, a change over signal for switch-off attributed to the interruption of the conduction of the fixed contact members 11*a*, 11*b* is outputted from the terminal 13.

Next, the manner of operation when the manipulating knob 22 is further pushed in the state shown in FIG. 6 is explained. Here, since the slide operating portion 17*d* further slides on the raised portion 15*b* of the conductive plate 15, the center of the leaf spring 19 is further pushed and deflected upwardly due to the elevated shaft 17*a* and, at the same time, the portion to be pushed 17*b* is further pushed downwardly by means of the pushing projection 22*b*. Accordingly, as shown in FIG. 7, the portion to be pushed 17*b* pushes the manipulating portion 24*a* so as to operate the pushing switch 24 whereby a driving signal which fully opens the window is outputted. Further, when the manipulating force applied to the manipulating knob 22 is removed in the state shown in FIG. 7, the slide operating portion 17*d* is pushed back along the inclined surface of the raised portion 15*b* due to the restoring force of the leaf spring 19 and hence, the slide operating portion 17*d* returns to the state shown in FIG. 5 by way of the state shown in FIG. 6.

Here, when the manipulating knob 22 is rotated in the clockwise direction in the drawing in the state shown in FIG. 5, the portion to be pushed 18*b* of the driver 18 is pushed by the pushing projection 22*c* of the manipulating knob 22 so that the arm 18*c* is rotated, and the slide operating portion 18*d* slides on the raised portion 16*b* of the conductive plate 16 whereby when the slide operating portion 18*d* passes over the fixed contact 12*a*, the conductive plate 16 is rotated. Accordingly, a switch-on changeover signal (drive signal for performing a closing operation of the window) which is generated due to the conductive state between the fixed contact members 12*a*, 12*b* is outputted from the terminal 14. Then, when the manipulating knob 22 is further pushed in this state, the pushing projection 22*c* pushes a manipulating portion 25*a* by way of the portion to be pushed 18*b* so as to operate the pushing switch 25 whereby it is possible to output the driving signal which makes the window fully closed. Further, when the manipulating knob 22 is rotated in the clockwise direction in FIG. 5, the pushing projection 22*b* is elevated so that the driver 17 assumes the non-loaded state. In this case, although the slide operating portion 17*d* moves on the initial receiving portion 15*a* and the portion to be pushed 17*b* is slightly pushed upwardly, the posture of the conductive plate 15 is not affected and there is no change with respect to an output signal from the terminal 14. Here, with respect to a series of these operations, the first and second switch elements have the same constitution and these operations can be easily estimated from the previously-mentioned manner of operation and hence, the detailed explanation is omitted.

As described above, in the switch device according to this embodiment, the drivers 17, 18 are sandwiched between the conductive plates 15, 16 and the leaf springs 19, 20, the portions to be pushed 17*b*, 18*b* of the drivers 17, 18 are resiliently brought into contact with the manipulating knob 22, and the slide operating portions 17*d*, 18*d* are resiliently brought into contact with the conductive plates 15, 16. That is, the leaf springs 19, 20 respectively resiliently bias the shafts 17*a*, 18*a* of the drivers 17, 18 toward the conductive plates 15, 16, and in the state in which the manipulating force is not applied, a force which makes the slide operating portions 17*d*, 18*d* descend along the inclined surface of the raised portions 15*b*, 15 acts on the slide operating portions 17*d*, 18*d* and hence, the portions to be pushed 17*b*, 18*b* are biased in the direction which pushes the pushing projections 22*b*, 22*c* of the manipulating knob 22 upwardly. Then, when the manipulating force is applied to the manipulating knob 22, the pushing projection 22*b* (or 22*c*) directly pushes the portion to be pushed 17*b* (or 18*b*) so as to make the slide operating portion 17*d* (or 18*d*) slide on the conductive plate 15 (or 16), while when the manipulating force applied to the manipulating knob 22 is removed, the portion to be pushed 17*b* (or 18*b*) pushes back the manipulating knob 22 and hence, there is no fear that the drivers 17, 18 and the manipulating knob 22 generate plays during manipulation whereby it is possible to always obtain the favorable manipulating feeling.

Further, in the switch device according to this embodiment, by preliminarily considering that the drivers 17, 18 are slightly rotated when the manipulating knob 22 is mounted in a preloaded state, the slide operating portions 17*d*, 18*d* are set such that the slide operating portions 17*d*, 18*d* are positioned over the initial receiving portions 17*a*, 18*a* of the conductive plates 15, 16 in the non-loaded state in which manipulating knob 22 is not present. Accordingly, there is substantially no fear that the positional displacement of the slide operating portions 17*d*, 18*d* on the conductive plates 15, 16 occurs when the manipulating knob 22 is mounted in the state that there is no play. Accordingly, an operational failure such as an undesirable earlier ON timing at the time of manipulation can be prevented in advance.

Further, in the switch device according to this embodiment, the drivers, 17, 18 can be directly pushed by the manipulating knob 22 and hence, it is unnecessary to interpose other actuating members. Further, it is possible to arrange the leaf springs 19, 20 which function as the restoring springs above the shafts 17*a*, 18*a* in the narrow space. Accordingly, it is possible to obtain an advantageous effect that the whole device can be made thin. Further, the pushing switches 24, 25 can be operated by the portions to be pushed 17*b*, 18*b* which are pushed by the manipulating knob 22 and hence, it is unnecessary to additionally attach the actuating members for the pushing switches 24, 25. Accordingly, although the switch device is of a multiple-function type which can perform the full-open and full-closing operation in addition to the manual operation, it is possible to prevent the structure from becoming complicated and the miniaturization and the reduction of thickness are not obstructed. Further, in this switch device, the conductive plates 15, 16, the drivers 17, 18, the leaf springs 19, 20 and the cover 21 are sequentially assembled to the bottom wall 10*a* of the casing 10 and hence, the switch device of this embodiment exhibits the excellent assemblage.

Further, in the switch device according to the present invention, both of the group of fixed contact members 11*a* to 11*c* and the group of fixed contact members 12*a* to 12*c*, both of the conductive plate 15 and the conductive plate 16, and both of the driver 17 and the driver 18 are all arranged in the point symmetry in a plan view in two sets of switch elements. Accordingly, it is possible to effectively make use of the space in the casing 10 so that the whole device can be easily miniaturized. Furthermore, the recesses 10*f*, 10*g* in which the shafts 17*a*, 18*a* are inserted such that they can be elevated and descended are formed in the side walls 10*c* of the casing 10 and the partition wall 10*d* and the slits 10*h* in which the arms 17*c*, 18*c* are inserted such that they can be elevated and descended are formed in the side walls 10*b* of the casing 10. Accordingly, it is possible to ensure the movable spaces for the drivers 17, 18 while suppressing the height dimension of the casing 10.

Here, when the leaf spring 19 and the leaf spring 20 can close the upper opening 10*e* of the casing 10 as a lid, the cover 21 can be omitted.

The present invention is carried out in the above-mentioned manner and can obtain advantageous effects described below.

The drivers which are resiliently biased to the spring members bring the portions to be pushed and the slide operating portions into resilient contact with the manipulating knob and the conductive plate respectively and hence, when the portions to be pushed are pushed by the manipulating knob, the slide operating portions slide on the conductive plates. Accordingly, there is no fear that the drivers and the manipulating knob generate plays during the manipulation whereby it is possible to always obtain the favorable manipulating feeling. Further, the contact position between the slide operating portion and the conductive plate in the non-loaded state in which the manipulating knob is not present is set by considering that the driver is slightly rotated when the manipulating knob is mounted in the preloaded state. Accordingly, there is substantially no fear that the positional displacement of the slide operating portion on the conductive plate occurs when the manipulating knob is mounted in the preloaded state whereby an operational failure such as an undesirable earlier ON timing at the time of manipulation can be prevented in advance.

Further, it is unnecessary to interpose other actuating members between the portions to be pushed of the drivers and the manipulating knob and the spring members which function as restoring springs can be arranged in a narrow space. Accordingly, it is possible to easily make the whole switch device thin. Further, since the conductive plates, drivers and the leaf springs can be assembled sequentially on the bottom wall of the casing, the switch device can exhibit the excellent assemblage.

What is claimed is:

1. A switch device comprising a casing having a bottom wall, two sets of switch elements which are incorporated into the casing, and a manipulation knob which has a pair of pushing projections for selectively operating the two sets of switch elements, the switch element including a plurality of fixed contact members which are fixed to the casing and are exposed on a bottom wall, a conductive plate which is tiltably arranged on the bottom wall and is brought into contact with and separated from at least one of the fixed contact members, a driver which is arranged above the conductive plate configured to permit an elevation/descending operation, and is rotatable about a shaft, and a spring member which resiliently biases the shaft of the driver toward the bottom wall, wherein the driver includes a portion to be pushed which is projected outside the casing in a sideward direction and is resiliently brought into contact with the pushing projection due to a biasing force of the spring member and a slide operating portion which slides on an inclined surface of the conductive plate when the portion to be pushed is pushed by one of the pushing projections, and wherein a preloaded state in which the one of the pushing projections pushes the portion to be pushed by a fixed quantity is established at the time of mounting the manipulating knob, and wherein a contact position between the slide operating portion and the conductive plate in a non-loaded state in which the manipulating knob is not present is set such that the slide operating portion is brought into contact with a given position on the conductive plate in the preloaded state.

2. A switch device according to claim 1, wherein the conductive plate includes a raised portion on which the inclined surface is formed, an initial receiving portion which is contiguously formed at one end of the raised portion and is brought into contact with the slide operating portion in the non-loaded state, and a movable contact which is extended from another end of the raised portion and is capable of being brought into contact with and separated from any one of the fixed contact members, and wherein in the preloaded state, the slide operating portion is brought into contact with the inclined surface in the vicinity of the initial receiving portion.

3. A switch device according to claim 2, wherein the plurality of fixed contact members include a first fixed contact member which is always brought into contact with the conductive plate and a second fixed contact member which is brought into contact with and separated from the movable contact, and wherein a contact between the first fixed contact member and the conductive plate is set as a tilting fulcrum of the conductive plate.

4. A switch device according to claim 3, wherein the plurality of fixed contact members include a third fixed contact member which is brought into contact with a portion of the conductive plate which is extended toward a side of the conductive plate opposite to a side of the raised portion from the initial receiving portion of the conductive plate.

5. A switch device according to claim 1, wherein in each set out of the two sets of switch elements, all of the group of fixed contact members, the conductive plate and the driver are arranged in a point symmetrical position as viewed in a plan view.

* * * * *